United States Patent [19]

Yamanaka et al.

[11] 4,177,224

[45] Dec. 4, 1979

[54] ALTITUDE COMPENSATION VALVE

[75] Inventors: Minoru Yamanaka; Akira Ii, both of Toyotashi, Japan

[73] Assignees: Aisin Seiki Kabushiki Kaisha; Toyota Jidosha Kogyo Kabushiki Kaisha, both of Aichi, Japan

[21] Appl. No.: 899,698

[22] Filed: Apr. 24, 1978

[30] Foreign Application Priority Data

Apr. 25, 1977 [JP] Japan ..... 52-47526

[51] Int. Cl.[2] ..... F02M 7/24

[52] U.S. Cl. ..... 261/39 A; 137/181; 261/121 B

[58] Field of Search ..... 261/121 B, 39 A; 137/181

[56] References Cited

U.S. PATENT DOCUMENTS

| | | | |
|---|---|---|---|
| 2,638,107 | 5/1953 | Teague, Jr. | 137/81 |
| 3,011,770 | 12/1961 | Stoltman | 261/39 A |
| 3,236,258 | 2/1966 | Teston | 137/81 |
| 3,493,217 | 2/1970 | Farley | 261/121 B |
| 3,752,141 | 8/1973 | Charron et al. | 261/DIG. 19 |
| 3,810,606 | 5/1974 | Masaki | 261/39 A |
| 3,987,131 | 10/1976 | Hisatomi et al. | 261/121 B |
| 4,008,696 | 2/1977 | Hisatomi | 261/DIG. 19 |
| 4,058,978 | 11/1977 | Bockelmann et al. | 261/121 B |

FOREIGN PATENT DOCUMENTS

| | | | |
|---|---|---|---|
| 2559079 | 9/1976 | Fed. Rep. of Germany | 261/121 B |

*Primary Examiner*—Tim R. Miles

*Attorney, Agent, or Firm*—Oblon, Fisher, Spivak, McClelland & Maier

[57] ABSTRACT

An atmospheric pressure responsive and vacuum actuated control valve applied to a fluid control system for maintaining the same absolute ratio of air rate by fuel rate in a combustible mixture in an intake manifold of a vehicle engine regardless of whether the vehicle engine is moved to higher altitudes. The valve has a succesive changing ability of a superimposed corrective quantity of air on the intake manifold in accordance with the altitude of the engine.

8 Claims, 2 Drawing Figures

ALTITUDE COMPENSATION VALVE

BACKGROUND OF THE INVENTION

1. Field of the Invention

This invention relates to an altitude compensating device and a fluid control system having the altitude compensating device incorporated therein and, in particular, relates to an altitude compensating device applied to the fluid control system, for example, for maintaining the same absolute ratio of air rate by fuel rate in a combustible mixture in a vehicle engine intake manifold regardless of whether the vehicle engine is moved to higher altitudes.

2. Description of the Prior Art:

There have been known in the art various devices which superimpose a fixed quantity of air on the vehicle engine intake manifold when atmospheric pressure falls below a predetermined value. They have proven to be unsatisfactory because of a lack of successively changing ability of the superimposed corrective quantity of air in accordance with the altitude of the engine.

SUMMARY OF THE INVENTION

A principal object of the invention is therefore to provide means to change the corrective quantity of air being superimposed on a device, such as, for example, a vehicle engine intake manifold in proportion to varying atmospheric pressure.

Another object of the invention is to provide an improved compensator adapted to vehicle engines for maintaining a predetermined ratio of air rate by fuel rate in the combustible mixture in the intake manifold regardless of the altitude or the environment in which the engine is operating.

With these objects and others in view, the present invention comprises generally an engine vacuum responsive diaphragm motor, a bellows means responsive to variation of atmospheric pressure for determining a distance of vacuum responsing movement of the diaphragm proportionally to varying degrees in atmospheric pressure, valve means operatively connected to the diaphragm and having at least an opening proportionally variable to the responsing movement of the diaphragm, and means for delivering air across the valve means.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DESCRIPTION OF THE PREFERRED EMBODIMENTS

Figure 1:
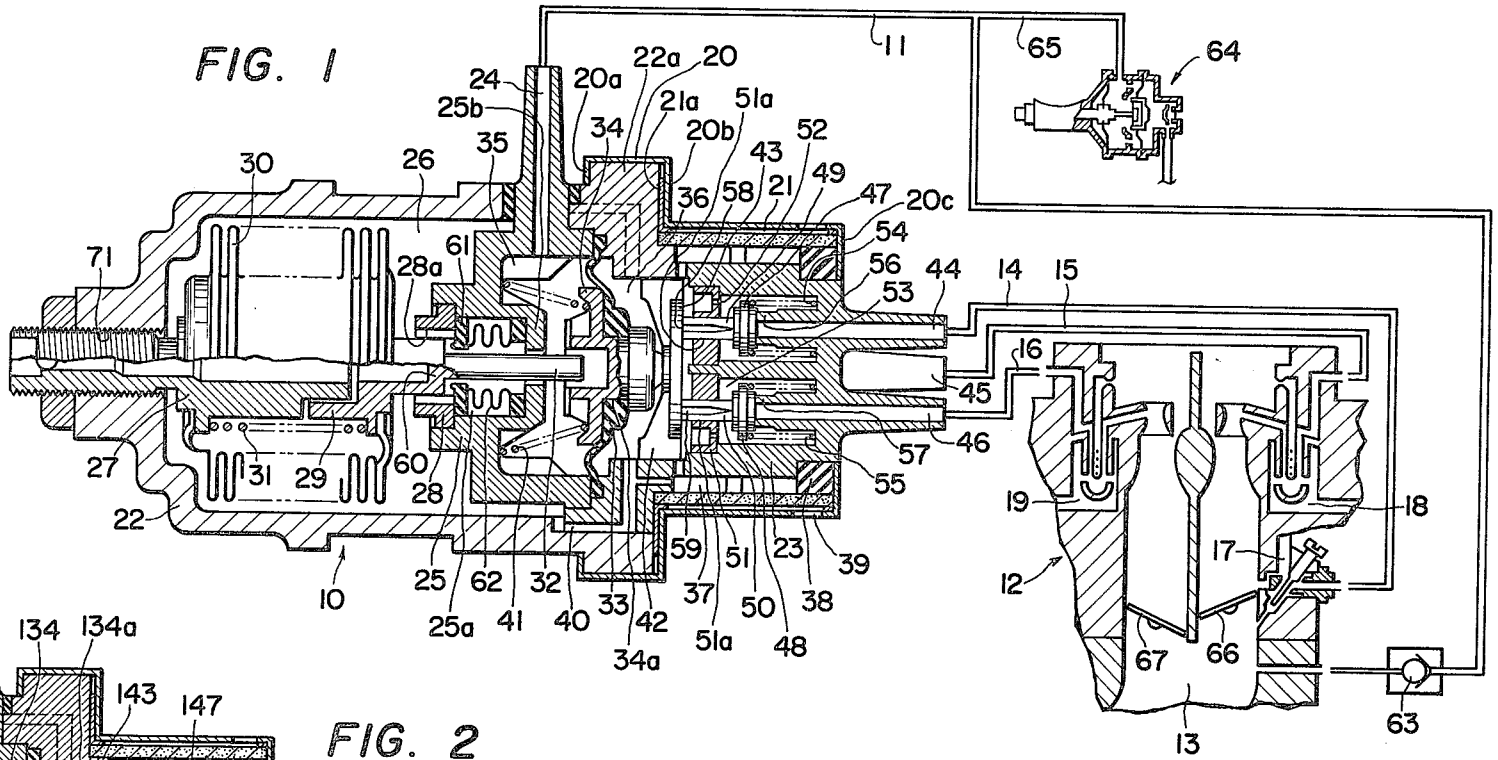
FIG. 1 is a longitudinal cross sectional of an altitude compensator as used in a vehicle engine incorporating a carburetor and ignition controller.

The altitude compensator 10 has a housing made up of housing members 22 and 23. The housing member 22 has a radial flange **22*a* that provides a support face for an outer radial flange 21*a* of a sheet metal cap 21. Another cap 20** has a pair of parallel radial inner flanges

**20*a* and 20*b* and clamps the outer radial flange 21*a* to the flange 22*a*. The cap 20 has another inner radial flange 20*c* which provides clamping of the housing member 23 to the other housing member 22 as well as substantially closing the right hand end of the housing member 23**.

Within the housing member 22 is contained a transverse wall 25 that defines a chamber 26. The chamber 26 contains therewithin a flexible bellows 30. The bellows 30 has a shaft 27 threadably extending through a tapped hole 71 in the end wall of the housing member 22 to be screwed thereinto. The shaft 27 is a closely slidably fit at its right hand end on a wall 29 so that the shaft and wall 29 are axially movable relative to each other. A compressed coil spring 31 is based against the shaft 27 and presses against the wall 29 to urge the wall 29 to expand away from the shaft 27 and hence the bellows to expand. The wall 29 has a stem 32 projecting therefrom to the right and having a step or shoulder 60. The stem 32 extends through an internally grooved hole **28*a* of a guiding member 28. The guide member and the wall 25 cooperate to define a suitable cavity 25*a* in which is contained an annular seat member 61 and a resilient hollow member 62. The guide member 28 has dual functions of slidingly guiding the stem 32 and holding the seat 61 and resilient member 62 captive in the cavity. The stem 32 further extends non-airtightly through the back wall 25*b* and its extremity faces to a movable wall 34** spaced therefrom a distance in the retracted position shown.

The movable wall 34 has an annular groove **34*a* for clamping or fitting the inner circumferential edge of an annular diaphragm 33. The movable wall 34 has further a guiding member 42 which is close sliding fit in the housing members 23 and 22 and a circular transmitting member 43**.

The diaphragm 33 has its outer circumferential edge clamped between the transverse wall 25 and the housing members 23 and 22, so that the diaphragm and the transverse wall 25 cooperate to define a chamber 35. The chamber 35 contains a compressed coil spring 41 based against the wall 25 and pressing against the inside of the wall 34 to urge it to expand away from the wall 25 together with the guide member 42. The diaphragm 33 cooperates with a second transverse wall 51 having an orifice 52 to define chambers 36 and 53. The second transverse wall 51 has a suitable thickness and provides airtight and slidable joints **51*a* for axially slitted stems of identical configuration (only two of them are shown in the view at 49 and 50). The stems 49 and 50 are formed at their ends with valves 47 and 48. The valves 47 and 48 are normally urged by light springs 54 and 55 toward disengagement from their seats 56 and 57 and toward sbutment against the transmitting member 43. The seats 54 and 55 are connected to conduits 14 and 16. The other non-illustrated seat is connected to a conduit 15**.

The spring 41 is so preloaded that it eclipses the total force of the light springs 56, 57 and a non-illustrated one. The preload spring therefore normally urges the associating parts as a unit against the seats 56 and 57 to thereby occupy the positions shown in the rest position of the device.

As shown at reference numbers 58 and 59, the axial slits of the stems 49 and 50 are somewhat like a laid V-shape so that openings between the chambers 36 and 53 formed by cooperation of the slits and the sliding fit joints **51*a* in the transverse wall 51** are enlargeable as the stems 49 and 50 move to the right relative to the wall 51. It will be understood that the quantity of air flow through the openings increases as the stems move to the right relative to the second transverse wall 51 and the reverse operation occurs as the stems reversely move.

The conduit 11 is connected across a check valve 63 to the intake manifold 13 of the carburetor 12, immediately downstream of a main throttle valve 66. The port 44 is connected through conduit 14 to a fuel nozzle 17, port 46 is connected through a conduit 16 to another fuel nozzle 19 and port 45 is connected through a conduit 25 with another fuel nozzle 18. A branch conduit 65 of conduit 11 leads to a servo-mechanisms 64 to actuate the known ignition controlling device of the engine.

The sheet metal cap 21 has an inlet-port 39 which communicates through a filter 38 and passageway 37 with the chamber 36 and, in turn, through a passageway 40 with the chamber 26.

In operation, the position of the wall 29 and hence the stem 32 is determined by the equilibrium of the internal pressure in the bellows 30 which is extremely and substantially constant, atmospheric pressure in chamber 26 and resiliency of the spring 31 which tries to expand the bellows.

Assuming that every part of the device is set for operation at about sea level, the bellows 30, and the diaphragm motor or wall 34 and hence the valves 47 and 48 occupy the closed positions shown. The chamber 36 and hence the chamber 26 are both connected to atmosphere through the passageway 40, air filter 38 and inlet opening 39. Under the conditions, the slits 58 and 59 assure the maximum effective communication between chambers 36 and 53, but valves 47 and 48 are brought into contact with seats 56 and 57 respectively so that the transmitting of atmospheric pressure to the ports 44, 45 and 46 will be interrupted. Since the chamber 35 is in communication with the chamber 26 through an airtight joint in the wall 25*b*, interior of flexible member 62, rubber seat 61 and grooved hole 28*a*, subatmospheric pressure in the manifold 13 will be reduced within chamber 35.

When the engine is moved to higher altitudes and atmospheric pressure falls below a threshold value, the bellows 30 expands and seats the stepped portion 60 to the rubber seat 61 with the result that the intercommunication between the chambers 26 and 35 is closed off. Accordingly, the subatmospheric pressure in the manifold reaches the chamber 35 through conduit 11 and signal port 24 with check valve 63 opened, and the chamber 35 operates at a pressure level dependent upon the manifold vacuum. As a result of pressure differential being applied to the opposite faces of the wall 34, the wall 34 will be moved to the left by air pressure on the right of the wall until it abuts against the end of the stem 32. The transmitting member 43 also moves to the left in accordance with the wall 34. As a result, the valves 47 and 48 are permitted to unseat from the seats 56 and 57 by the light springs 54 and 55 in accordance with the transmitting member 43 and occupy positions a distance away from the seats dependent upon the position of the end of the stem 32 which, in turn, is governed by the value of atmospheric pressure to which the bellows 30 in chamber 26 is exposed.

At the threshold value level of atmospheric pressure, the valves 47 and 48 are moved to their leftwardmost locations, so that little or no opening is provided by cooperation of the slits 58 and 59 and their corresponding joints 51*a* in the wall 51 for communication between the chambers 36 and 53. However, a minimum communication is assured by arrangement of orifice 52 between the chambers 36 and 53.

When the engine further moves to higher altitudes, a resultant decrease in atmospheric pressure will permit the bellows 30 to proportionally expand. The expansion of the bellows is transmitted through the wall 29, stem 32, movable wall 34, guide member 42 and transmitting member 43 to the stems 49 and 50 to move to the right. As the stems 49 and 50 move to the right, opening formed by cooperation of the slits 58 and 59 and their corresponding joints in the wall 51 are proportionally enlarged with a result of proportional increase in quantity of air flow therethrough. It will be understood that due to the V-shape slits 58 and 59, which are decisive of requirements in compensating for variation in altitude of the engine, a corrective quantity of air can be superimposed on the intake manifold. In other words, the rate of air in the combustible mixture admitted in the combustion chamber is kept to a preset value regardless of the altitude or the environment in which the engine is operating, or regardless of whether the engine is moved to higher altitudes.

Figure 2:
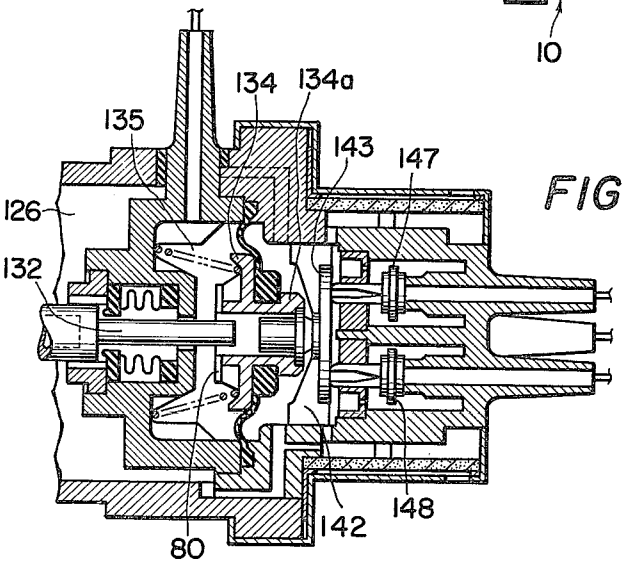
FIG. 2 is a partial sectional view of the compensator of FIG. 1 showing a alternate construction for transmitting movement of the diaphragm to the valve means. cl

In an alternate construction of FIG. 2, the guiding member 142 is formed separately from the movable wall 134 but is in operational engagement therewith at the annular shoulder or stepped portion 134*a* of the movable wall 134 so that they can move as a unit with assistance of light springs (not shown in FIG. 2 but are of a configuration comparable to that of the light springs 54 and 55 in FIG. 1). The movable wall 134 at its left side has a valve 80 which seats to the right side of the movable wall 134 so that intercommunication is blockaded between the chamber 135 and 126 when the chamber 135 operates at a pressure level dependent upon the pressure in the manifold and the stem 132 abuts against the guiding member 142. The stem 132 is not affected therefore by the manifold vacuum in the chamber 135 when the stem 132 begins to move to the right in response to the subsequent drop of atmospheric pressure due to transfer of the engine to a higher altitude. The other operations of the unit are obviously the same as that of FIG. 1.

Obviously, many modifications and variations of the present invention are possible in light of the above teachings. It is therefore to be understood that within the scope of the appended claims the invention may be practiced otherwise than as specifically described herein.

What is claimed is:

1. A device for maintaining the same absolute ratio of air by fuel in the combustible mixture in the intake manifold of the vehicle engine regardless of whether the engine is moved to high altitude, said device comprising:

housing means defining in part first and second chambers connected to each other by a fluid passage and both connected to atmospheric pressure, a flexible vacuum operated diaphragm extending in the second chamber to separate therefrom a cavity;

biasing means for urging the diaphragm to a first position;

first valve means through which the cavity and the first chamber is in intercommunication;

second valve means engaging the diaphragm and having an opening variable in proportion to a distance of vacuum actuated movement of the diaphragm, said second valve means being connected to the second chamber;

port means connecting to the second valve means for delivering air therefrom;

conduit means connecting the port means to the vehicle engine carburetors adjacent to a fuel injection nozzle;

an expansible bellows means in the first chamber containing an internal pressure approximately absolute vacuum;

means operatively connecting said bellows means to said first valve means so that expansion of the bellows means is in a direction to close the first valve means;

conduit means interconnecting said cavity with the carburetor of the engine downstream of the throttle valve for reducing pressure within the cavity so that responsive movement of the diaphragm with the transmitting member is in a direction to enlarge opening of the second valve means, and means operatively connecting said bellows means to the diaphragm so that a distance of vacuum actuated movement of the diaphragm from the first position to a second position is in accordance with the expansion of the bellows.

2. A device as set forth in claim 1 wherein the bellows means is locationally adjustable within the first chamber.

3. A device as set forth in claim 1 wherein the second valve means includes at least one stem having an axially extending and successively width varying slit, and a guiding joint member in which the stem is a close sliding fit so as to provide an opening variable in accordance with movement of the stem relative to the guiding and joint member.

4. A device for attachment to an internal combustion engine having a carburetor with at least one throttle valve, at least one fuel injection nozzle, and an intake manifold comprising:

manifold vacuum responsive means actuated by pressure in said manifold, valve means operatively connected to said manifold vacuum responsive means for varying opening thereof in proportion to movement of said vacuum responsive means, means delivering air through the said opening varying valve means into the carburetor adjacent the fuel nozzle;

valve means normally opened for controlling vacuum response of the manifold vacuum responsive means;

a valve seating and a stopper means responsive to atmospheric pressure including altitude compensation means operable in accordance with the altitude of the engine;

a seating member to seat the normally opened valve means for closing thereof so that manifold vacuum becomes active to the manifold vacuum responsive means; and a stopper member operatively connected to the manifold vacuum responsive means to stop the vacuum actuated movement thereof in accordance with expansion of the altitude compensation means.

5. A device as set forth in claim 4 wherein the compensation means comprises a sealed evacuated bellows means.

6. A device as set forth in claim 4 wherein said manifold vacuum responsive means comprises a diaphragm exposed normally to manifold vacuum and the normally opened valve means is interposed between the diaphragm and the manifold and operatively connected to said seating means.

7. An altitude compensating device comprising:

a housing having an inlet port, an outlet port, and a signal port;

means for defining first and second chambers within said housing, said first chamber constituting an atmospheric chamber;

a bellows means disposed within said atmospheric chamber and expansible in response to a variation in atmospheric pressure;

a movable means arranged within said second chamber to thereby divide said second chamber into a signal pressure chamber which receives a signal pressure through means of said signal port and a third chamber which is adapted to be in communication with said inlet and outlet ports, said movable means being movable in response to the signal pressure within said signal chamber;

a stopper means movable with said bellows means and limiting the movement of said movable means;

a valve means positioned within said third chamber to thereby control the fluid communication between said inlet and outlet ports, and said valve means being moved in its opening direction in response to the movement of said movable means and including a slit means to thereby decrease the effective area for fluid communication between said inlet and outlet ports in response to increase in movement of said movable means.

8. A device as set forth in claim 7, wherein said movable means includes a first portion which is movable in response to the signal pressure within said signal chamber, and a second portion which is movable with said first portion and is engageable with said valve means and said stopper means, said first and second portion being formed as separate bodies.

* * * * *